US009220377B2

(12) United States Patent
Fitzpatrick et al.

(10) Patent No.: US 9,220,377 B2
(45) Date of Patent: Dec. 29, 2015

(54) FOAM DISPENSING PUMP WITH DECOMPRESSION FEATURE

(71) Applicant: Rubbermaid Commercial Products, LLC, Winchester, VA (US)

(72) Inventors: Kevin Fitzpatrick, Winchester, VA (US); Emil Vulcu, Winchester, VA (US)

(73) Assignee: RUBBERMAID COMMERCIAL PRODUCTS, LLC, Winchester, VA (US)

( * ) Notice: Subject to any disclaimer, the term of this patent is extended or adjusted under 35 U.S.C. 154(b) by 114 days.

(21) Appl. No.: 13/956,750

(22) Filed: Aug. 1, 2013

(65) Prior Publication Data

US 2014/0034679 A1 Feb. 6, 2014

Related U.S. Application Data

(60) Provisional application No. 61/678,767, filed on Aug. 2, 2012.

(51) Int. Cl.

| | |
|---|---|
| ***B65D 23/06*** | (2006.01) |
| ***A47K 5/16*** | (2006.01) |
| ***A47K 5/12*** | (2006.01) |
| ***A47K 5/14*** | (2006.01) |
| ***B05B 7/00*** | (2006.01) |
| ***B05B 11/00*** | (2006.01) |

(52) U.S. Cl.

CPC ..... *A47K 5/16* (2013.01); *A47K 5/1205* (2013.01); *A47K 5/14* (2013.01); *B05B 7/0037* (2013.01); *B05B 11/3087* (2013.01)

(58) Field of Classification Search

CPC ..... B67D 7/58; B67D 7/76; B65D 23/06

USPC ..... 222/1, 108–111, 145.5–145.6, 190, 222/321.1–321.9, 383.1, 189.06–189.11

See application file for complete search history.

(56) References Cited

U.S. PATENT DOCUMENTS

| | | | | |
|---|---|---|---|---|
| 4,640,443 | A * | 2/1987 | Corsette | 222/321.3 |
| 5,249,718 | A | 10/1993 | Muderlak | |
| 5,305,915 | A | 4/1994 | Kamysz et al. | |
| 5,348,189 | A * | 9/1994 | Cater | 222/1 |
| 5,443,569 | A * | 8/1995 | Uehira et al. | 222/190 |

(Continued)

OTHER PUBLICATIONS

Kevin Fitzpatrick, International Application No. PCT/US2013/53336, International Search Report and Written Opinion, Dec. 18, 2013.

*Primary Examiner* — Paul R Durand
*Assistant Examiner* — Andrew P Bainbridge
(74) *Attorney, Agent, or Firm* — Marshall, Gerstein & Borun LLP

(57) ABSTRACT

A dispenser comprises a liquid piston and a gas piston coupled for movement. The pistons are mounted for movement relative to one another to define a mixing chamber therebetween. An actuator simultaneously moves the pistons in a first direction such that the air piston delivers air from an air chamber to the mixing chamber and the liquid piston delivers a liquid from a liquid chamber to the mixing chamber where the air and liquid are mixed in the mixing chamber to create a foam. Movement of one of the air piston and the liquid piston is stopped such that the pistons move relative to one another such that only air is delivered to the mixing chamber. The movement of the pistons in a second direction draws residual foam from a delivery tube and delivers the residual foam to the air chamber.

16 Claims, 10 Drawing Sheets

(56) References Cited

U.S. PATENT DOCUMENTS

| | | | | |
|---|---|---|---|---|
| 5,458,289 | A * | 10/1995 | Cater | 239/119 |
| 5,560,520 | A * | 10/1996 | Grogen | 222/321.2 |
| 5,785,208 | A * | 7/1998 | Dobbs et al. | 222/148 |
| 5,884,808 | A | 3/1999 | Muderlak et al. | |
| 6,053,364 | A * | 4/2000 | van der Heijden | 222/145.6 |
| 6,467,651 | B1 | 10/2002 | Muderlak et al. | |
| 6,626,332 | B2 * | 9/2003 | Ehrensperger et al. | 222/190 |
| 6,651,851 | B2 | 11/2003 | Muderlak et al. | |
| 6,929,150 | B2 | 8/2005 | Muderlak et al. | |
| 7,004,356 | B1 | 2/2006 | Sayers | |
| 7,191,920 | B2 | 3/2007 | Boll et al. | |
| 7,267,251 | B2 | 9/2007 | Ophardt | |
| 7,364,053 | B2 | 4/2008 | Ophardt | |
| 7,374,066 | B2 | 5/2008 | Jackson et al. | |
| 7,451,894 | B2 | 11/2008 | Ophardt | |
| 7,461,762 | B2 | 12/2008 | Law et al. | |
| 7,527,178 | B2 | 5/2009 | Lewis | |
| 7,540,397 | B2 | 6/2009 | Muderlak et al. | |
| 7,611,030 | B2 | 11/2009 | Reynolds et al. | |
| 7,621,426 | B2 | 11/2009 | Reynolds et al. | |
| 7,681,765 | B2 | 3/2010 | Muderlak | |
| 7,708,166 | B2 | 5/2010 | Ophardt | |
| 7,735,692 | B2 | 6/2010 | Nelson | |
| 7,766,194 | B2 | 8/2010 | Boll et al. | |
| 8,113,389 | B2 | 2/2012 | Lewis et al. | |
| 2005/0224519 | A1 | 10/2005 | Law et al. | |
| 2008/0237266 | A1 * | 10/2008 | Ciavarella et al. | 222/190 |
| 2009/0020552 | A1 * | 1/2009 | van der Heijden | 222/1 |
| 2010/0193547 | A1 * | 8/2010 | Laidler et al. | 222/190 |
| 2010/0320232 | A1 * | 12/2010 | van der Heijden et al. | 222/135 |

* cited by examiner

FOAM DISPENSING PUMP WITH DECOMPRESSION FEATURE

This application claims benefit of priority under 35 U.S.C. §119(e) to the filing date of U.S. Provisional Application No. 61/678,767, as filed on Aug. 2, 2012, which is incorporated by reference herein in its entirety.

BACKGROUND

Dispensers are known that dispense materials such as soaps, detergents, lotions or other similar liquids in environments such as bathrooms, kitchens or the like. In some applications the dispensers deliver a foamed liquid to a user upon actuation of the dispenser.

SUMMARY OF THE INVENTION

In some embodiments a dispenser comprises a liquid piston and a gas piston coupled for movement. An actuator moves the liquid piston and the air piston in a first direction such that the air piston delivers air from an air chamber to a mixing chamber and the liquid piston delivers a liquid from a liquid chamber to the mixing chamber where the air and liquid are mixed in the mixing chamber to create a foam that is dispensed from a delivery tube. The movement of the liquid piston and the gas piston in a second direction draws residual foam from the delivery tube and delivers the residual foam from the delivery tube to the air chamber.

In some embodiments a dispenser comprises a housing. A liquid piston and a gas piston are coupled for movement in the housing where the liquid piston and the gas piston are mounted for movement relative to one another to define a mixing chamber therebetween. An actuator simultaneously moves the liquid piston and the air piston in a first direction such that the air piston delivers air from an air chamber to a mixing chamber and the liquid piston delivers a liquid from a liquid chamber to the mixing chamber where the air and liquid are mixed in the mixing chamber to create a foam. A stop stops movement of one of the air piston and the liquid piston such that the air piston moves relative to the liquid piston such that only air is delivered to the mixing chamber. A delivery tube dispenses the foam.

The air chamber may be in communication with a container that holds the liquid via a drain valve. The drain valve may open when the liquid piston and the gas piston move in the first direction. The movement of the liquid piston and the gas piston in the second direction may draw liquid from the container into the liquid chamber. The movement of the liquid piston and the gas piston in the second direction may open a valve between the container and the liquid chamber. The movement of the liquid piston and the gas piston in the first direction may open a drain valve in the air chamber to allow residual foam in the air chamber to drain from the air chamber. A valve may communicate the mixing chamber with ambient air. At least a portion of the liquid piston may be mounted for movement relative to the air piston. A flexible diaphragm may connect at least a portion of the liquid piston to the air piston. A compression member may be disposed between the air piston and the liquid piston. The relative movement between the air piston and the liquid piston may draw air into the mixing chamber without drawing liquid into the mixing chamber. Apertures may be formed in the liquid piston for communicating the mixing chamber with the air chamber. The residual foam may travel through the apertures as the residual foam is delivered to the air chamber. A foam densifier may be disposed between the mixing chamber and the delivery tube such that the foam passes through the foam densifier to the delivery tube. The residual foam may travel through a path that bypasses the foam densifier as the residual foam is delivered to the air chamber. The movement of the liquid piston and the gas piston in the second direction may create a vacuum in the liquid chamber that draws liquid from the container. The movement of the liquid piston and the gas piston in the second direction may create a vacuum in the air chamber that draws residual foam from the delivery tube.

A method of dispensing a foam comprises providing a liquid piston and a gas piston defining a mixing chamber and a delivery tube for dispensing a foam from the mixing chamber; moving the liquid piston and the air piston in a first direction such that the air piston delivers air from an air chamber to the mixing chamber and the liquid piston delivers a liquid from a liquid chamber to the mixing chamber such that the air and liquid are mixed in the mixing chamber to form the foam; and moving the liquid piston and the gas piston in a second direction to draw residual foam from the delivery tube and deliver the residual foam from the delivery tube to the air chamber.

DETAILED DESCRIPTION OF EMBODIMENTS OF THE INVENTION

Figure 1:
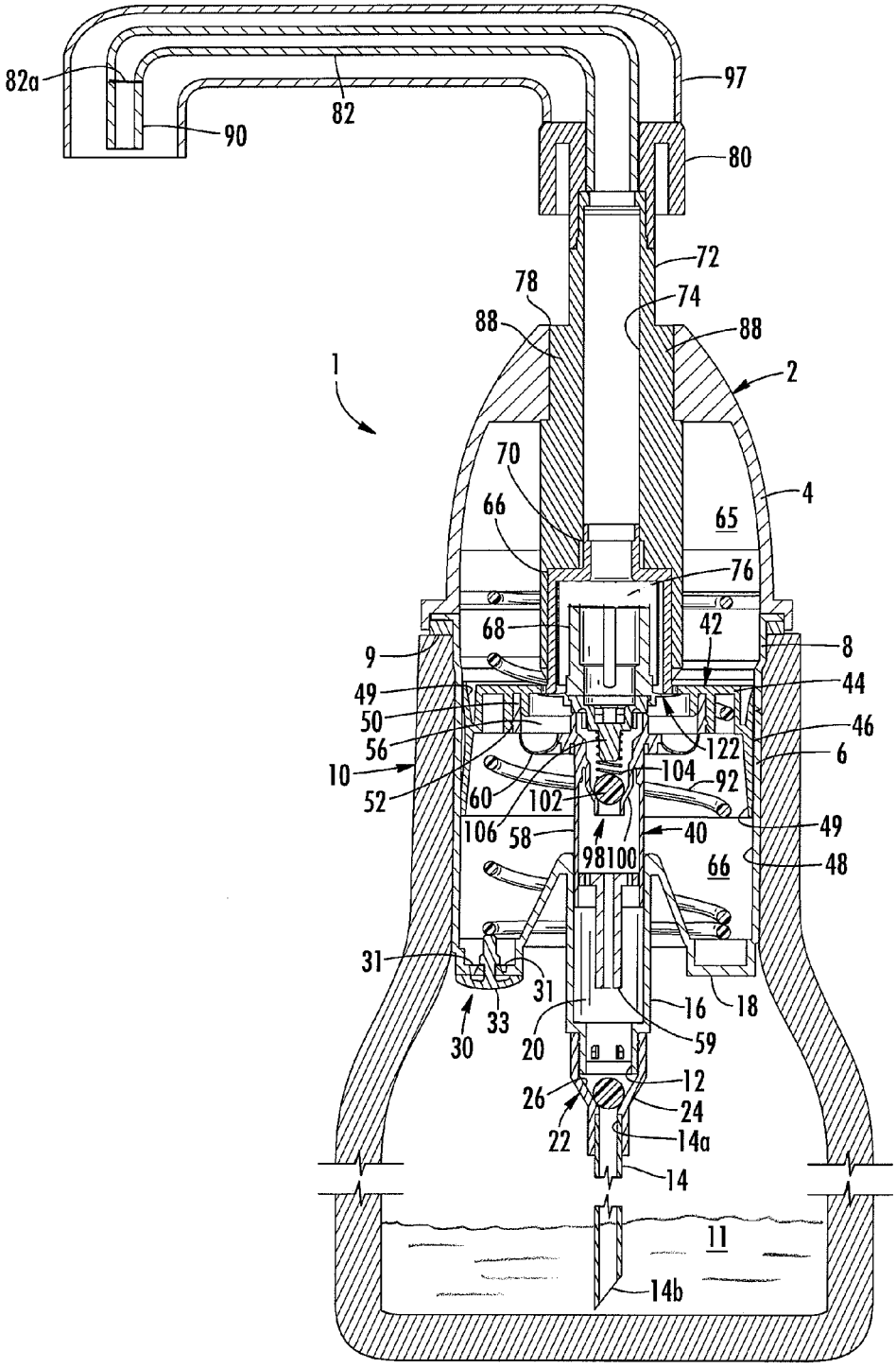
FIG. 1 is a section view of an embodiment of the dispenser assembly of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

A foam pump dispenser with a decompression feature that prevents dripping of the foamed liquid from the dispenser is disclosed. The pump dispenser also provides a dispenser that fully mixes the liquid with air to fully foam the dispensed material. The pump dispenser and associated dispensing system may be used to dispense soap foam, hand sanitizer foam or other similar foams such as shampoos, lotions or the like from a liquid supply and may be used for hand washing, skin care or other purposes in bathrooms, restrooms, kitchens or other environments. The pump dispenser can be used in any environment to discharge, either manually or automatically, any type of foam that is a mixture of a liquid and a gas. The pump dispenser may be electronically actuated or manually actuated.

The pump dispenser prevents residual foam in the delivery tube from suspending from the end of the delivery tube to create a "foam tail" as is common to other known dispensers. In some foam dispensers, foam remains in the dispensing tube after pump actuation which may then form the unwanted "foam tail". The "foam tail" may drip onto the counter, sink or other surface and create a sticky residue as the liquid dries. The pump dispenser described in detail herein effectively eliminates the foam tail and dripping of fluid and is inexpensive and simple to manufacture. The decompression feature or the pump dispenser allows the pump to vacuum-back some of the liquid/foam in the delivery tube and tip in such a way that a "foam tail" will not hang from the tip of the delivery tube at the end of liquid soap/foam dispensing cycle.

In use, the pump may be typically mounted on a liquid refill container by, for example, a crimping ferrule, where the container may contain liquid soap, hand lotion or other liquids. The liquid refill container and pump dispenser may be loaded on or into an automatic or manual liquid/foam dispenser system. The dispenser system may use an automatic or manual operator that moves the actuator of the pump dispenser to pump liquid/foam from the container. At the end of the dispensing cycle, the foam is discharged completely without any foam tail hanging from the delivery tube tip that may drip onto to the counter, sink or other surface. Eliminating the dripping of the dispensed fluid eliminates the mess created by the dripping fluid and the associated clean-up work, and minimizes waste of the dispensed product.

The pump dispenser as described herein may be used in a dispenser system to dispense foam such as soap or sanitizer. The pump dispenser may be installed with a refill container filled with the liquid to be foamed. A fill tube may extend to the bottom of the refill container to deliver the liquid to the pump dispenser. The container and pump dispenser may be disposable and may be removably inserted into the dispenser system. The delivery tube delivers the foamed liquid to the point of use. The delivery tube may be located in a decorative spigot and the refill container and pump dispenser may be located out of sight such as beneath a sink, for example. The compression stroke for actuating the pump dispenser may be generated by a user manually depressing the actuator or by using an automatic system. The automatic system may comprise a suitable sensor for sensing the presence of a user adjacent to the dispenser, or other condition. The sensor may actuate a motor such as an electric motor that moves the actuator through the compression stroke. The actuator and pump may be returned on the extension stroke by a spring.

Figure 2:
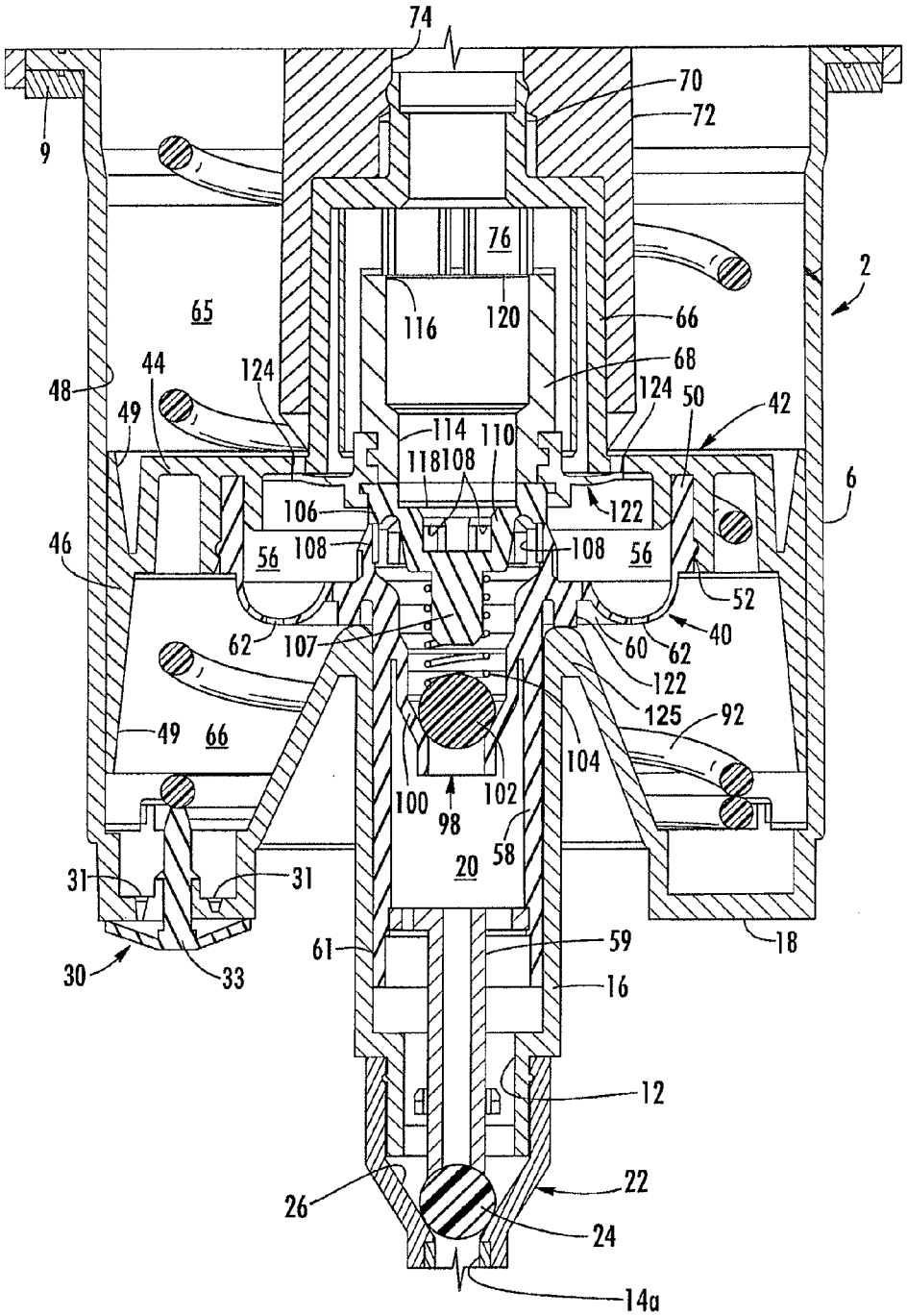
FIG. 2 is a detailed section view of the dispenser assembly of FIG. 1.
Figure 3:
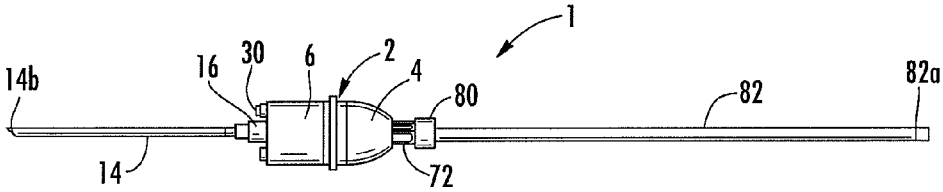
FIG. 3 is a side view of an embodiment of the pump dispenser of FIG. 1.
Figure 4:
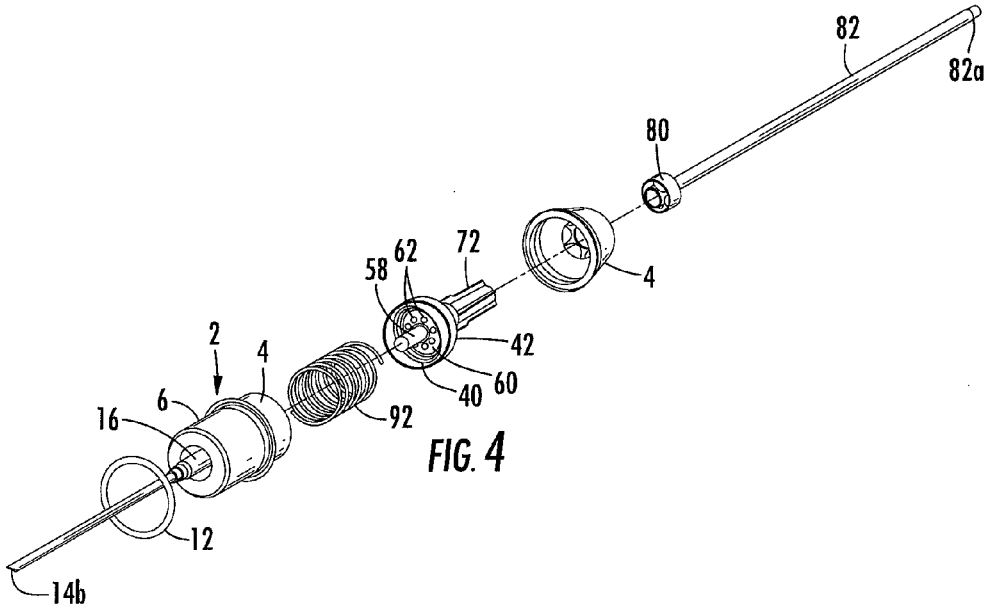
FIG. 4 is an exploded view of an embodiment of the pump dispenser of FIG. 1.
Figure 5:
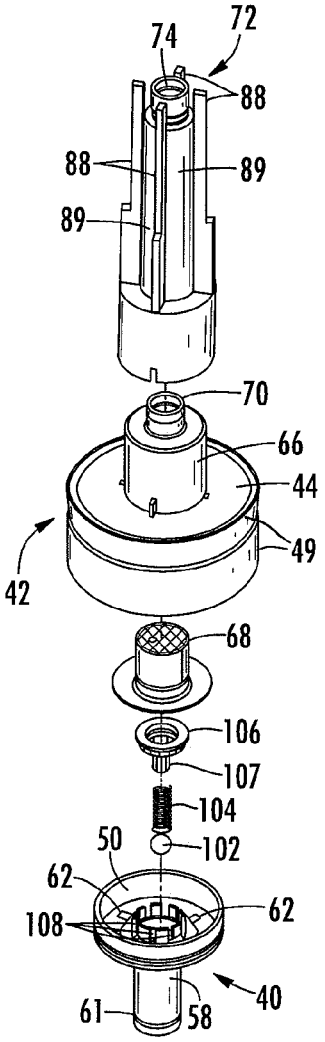
FIG. 5 is an exploded view of an embodiment of the components of the pump dispenser of FIG. 1.
Figure 6:
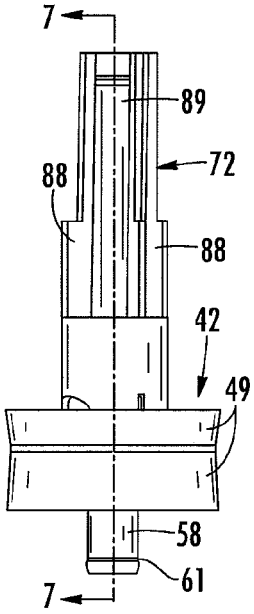
FIG. 6 is a side view of some of the components of FIG. 5.
Figure 7:
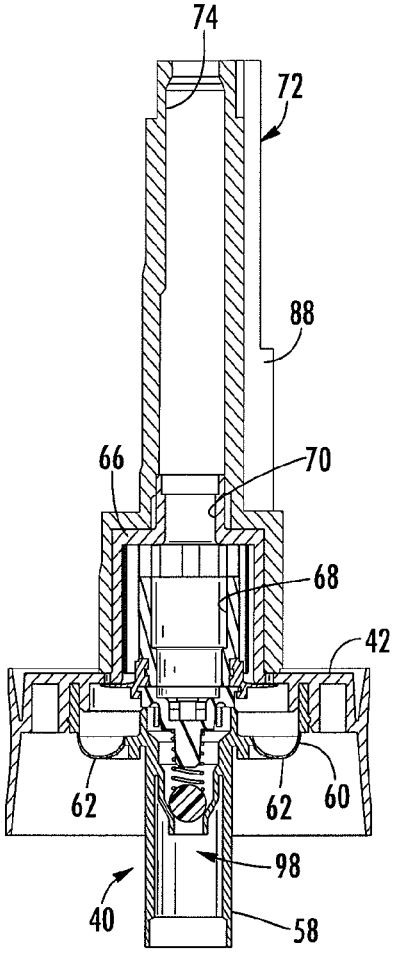
FIG. 7 is a section view taken along line 7-7 of FIG. 6.
Figure 8:
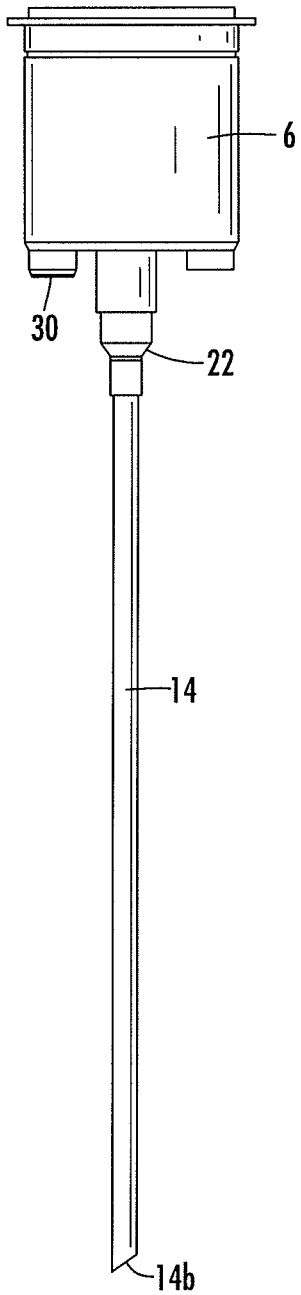
FIG. 8 is a side view of some of the components of FIG. 5.
Figure 9:
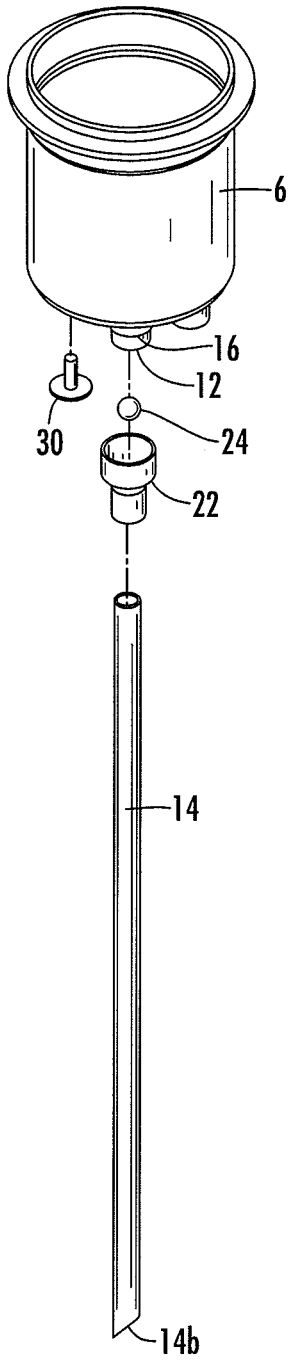
FIG. 9 is a perspective exploded view of the components of FIG. 8.
Figure 10:
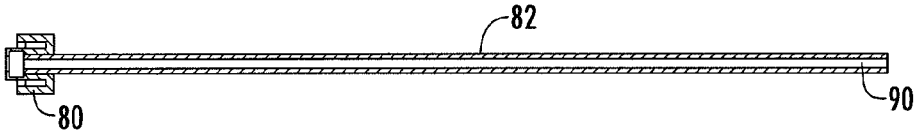
FIG. 10 is a plan view of additional components of FIG. 5.
Figure 11:
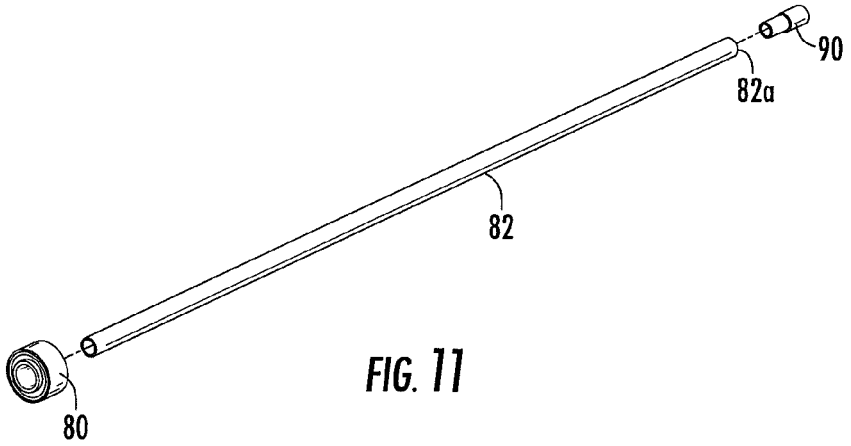
FIG. 11 is a perspective exploded view of the components of FIG. 10.
Figure 12:
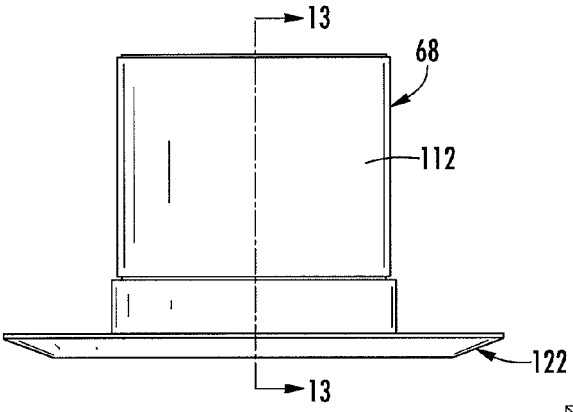
FIG. 12 is a side view of further components of FIG. 5.
Figure 13:
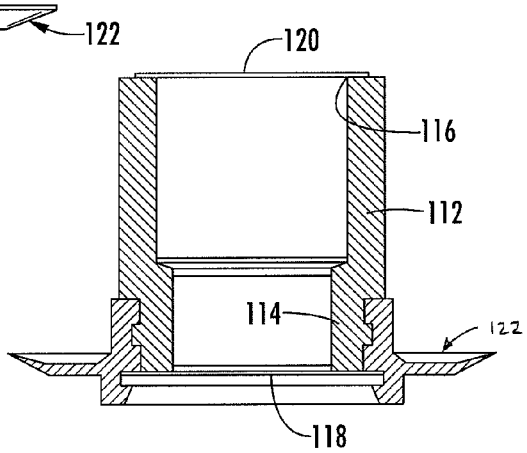
FIG. 13 is a section view taken along line 13-13 of FIG. 12.
Figure 14:
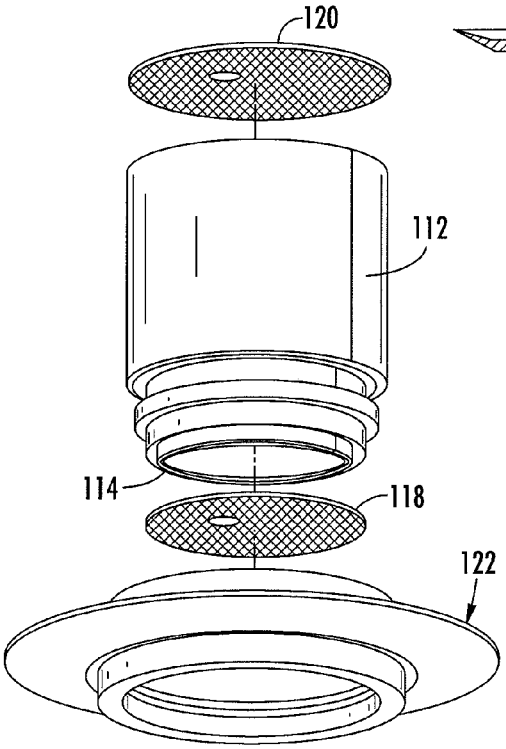
FIG. 14 is a perspective exploded view of the components of FIG. 12.

Referring to FIGS. 1 and 2 in one embodiment the pump dispenser 1 may comprise a housing 2 that supports the pump components. The housing 2 may comprise a first portion 4 such as a pump cover and a second portion 6 such as a pump base that together form the housing. The first portion 4 and the second portion 6 may be secured to one another to secure the pump dispenser components in the housing 2. The housing portions 4 and 6 may be secured together by any suitable mechanism including screwthreads, a friction fit, interference fit or mechanical engagement, adhesive, welding, separate fasteners, other attachment mechanisms or combinations of such mechanisms. In one embodiment the housing 2 is configured to fit into the opening 8 of a refill container 10 containing a liquid to be dispensed 11 such that a liquid tight seal is formed between the housing 2 and the container 10. A gasket or seal 9 may be provided to seal the container 10 to the housing 2 and any suitable mechanism, such as a crimping ferrule, may be used to secure the housing 2 to the container 10.

In some embodiments the pump dispenser 1 may be permanently connected to the container where the refill container 10 and pump dispenser are releasably connected to the dispenser system as a unit. In some embodiments a portion of the pump dispenser may be permanently attached to the refill container and a portion of the pump dispenser may be permanently attached to the pump system. For example, the pump cover 4 may be permanently attached to the pump system at the point of use and the refill container 10 and pump base 6 may be permanently attached to one another such that an empty refill container and pump components may be removed from the system and a full refill container and attached components may be attached to the system. "Permanently" as used herein means that the components are not disassembled to replenish the supply of liquid at the point of use; however, the components may be removable for maintenance, repair or to refill the fluid.

The pump dispenser 1 may also be releasably attached to the refill container 10 by a friction fit, separate fasteners, a screwthread or quick connect coupler or other releasable connector. In such an embodiment the refill container 10 may be removed from the pump dispenser when empty and may be refilled or replaced by a second full refill container.

The container 10 may comprise any suitable container for retaining the liquid to be dispensed including a bottle, carton, bag or the like. Moreover, the container 10 may be connected to the pump dispenser 1 via intermediate elements such as a hose or conduit rather than being directly connected to the container 10 as shown. Moreover, while in some embodiments the container 10 is removable from the pump dispenser 1, in other embodiments the container 10 may be permanently affixed to the pump dispenser 1 or to portions of the pump dispenser such that the pump dispenser, or portions of the pump dispenser, and container 10 are replaced or refilled as a unit when the container is empty.

The bottom 18 of the housing 2 defines a liquid inlet 12 for receiving the liquid from the container 10 via a fill tube 14. The inlet 12 is in fluid communication with a liquid cylinder 16 that is formed in or attached to the bottom wall 18 of the housing 2. Liquid cylinder 16 defines a part of the liquid chamber 20 through which liquid flows from the container 10 into the pump dispenser 1. Intermediate the inlet 12 and the fill tube 16 is a liquid cylinder check valve 22 comprising a movable valve element 24, such as a ball, that selectively seals against valve seat 26 to close the inlet 12 as will be described. The check valve may have a variety of configurations, for example, the valve may comprise a crack pressure valve such as a duck bill valve. Other suitable check valves may also be used. One proximal end 14*a* of the fill tube 14 is connected to the check valve 22 and the opposite distal end 14*b* of the fill tube 14 extends into the container 10 to draw liquid 11 from the container and to deliver the liquid to the pump inlet 12. In some embodiments the distal end 14*b* of the fill tube 14 extends to the bottom of the container 10.

The bottom 18 of the housing also comprises a drain valve 30 having a valve element 33, such as an umbrella valve, that functions to release liquid from the air chamber 66 of the pump dispenser 1 back into the container 10 as will be described. The drain valve 30 comprises a one-way valve where valve element 33 may be moved away from the bottom wall 18 to allow fluid to flow out of the pump dispenser via apertures 31 and moved against the bottom wall 18 to seal apertures 31. In one embodiment the valve element 33 is moved to the open position by the air pressure in air chamber 66. Valves other than the umbrella valve shown in the drawings may be used as the drain valve 30.

The pump dispenser further comprises a liquid piston 40 that is coupled to an air piston 42 such that the air piston 42 and the liquid piston 40 form a piston assembly that moves in a linear reciprocating manner inside of the housing 2. A spring 92 may be located in the housing 10 for biasing the piston assembly upward.

The air piston 42 comprises a generally cylindrical cup portion 44 defined by an outer wall 46 that engages the generally cylindrical inner cylinder wall 48 of the housing 10 to form an air tight seal therebetween and to define an atmosphere side air chamber 65 and a pump side air chamber 66. The outer wall 46 may be formed with deformable portions 49 that resiliently engage the inner wall 48 of the housing 10 to form a seal. The air piston 42 and seals 49 are arranged such that the air piston 42 is free to move along the longitudinal axis of the housing 2 toward and away from inlet 12 while maintaining the seal with the housing wall 49.

The air piston 42 is mounted to the liquid piston 40 such that these pistons move together as a piston assembly in housing 10. The air piston 40 and liquid piston 42 may be coupled to create a mixing chamber 56 between the air piston 42 and the liquid piston 40. In one embodiment, the liquid piston 40 may be formed with a sleeve 50 made of rigid material such as molded plastic that fits into a mating annular receptacle 52 formed in the bottom of the cup portion 44 of the air piston 42. The cylindrical sleeve 50 may be force fit into the annular receptacle 52 to create a sealed, interference fit between the air piston 42 and the liquid piston 40 and to create a mixing chamber 56 between the air piston 42 and the liquid piston 40. The air piston 40 and liquid piston 42 may be joined by any suitable mechanism in addition to or in place of the interference fit shown herein provided a liquid tight seal is created between the pistons. For example, separate seals such as O-rings may be used between the liquid piston and the air piston, adhesive and/or welding may also be used in addition to or in place of the illustrated interference fit.

The sleeve 50 is connected to a piston tube 58 by a flexible diaphragm 60. The diaphragm 60 is formed of a flexible material and with a curved profile that allows the piston tube 58 to move relative to the sleeve 50 along the axis of the pump dispenser. The diaphragm 60 is also formed with a plurality of holes 62 that communicate the mixing chamber 56 with the pump side air chamber 66. The piston tube 58 is slidably received in the cylinder 16 formed in the bottom of the housing 10. The piston tube 58 and cylinder 16 together create the liquid chamber 20. The end of the piston tube 58 forms a liquid tight seal 61 with the interior of the cylinder 16 such that liquid in chamber 20 may only exit the chamber 20 via valve check valve 98. A tube 59 may be mounted to liquid piston tube 58 that communicates with piston tube 58 and cylinder 16 to allow liquid to flow from inlet 12 to fill chamber 20. The tube 59 is dimensioned such that it holds the valve 22 closed during the end of the compression step.

The air piston 42 further comprises a portion 66 that extends from the top of portion 44 to create a cavity 76 for receiving a foam densifier 68 and a one way valve 122. The exterior of portion 66 comprises a nipple 70 that is connected to a passage 74 formed in actuator 72 such that a liquid tight seal is formed between the nipple 70 of air piston 42 and the passage 74 of actuator 72. The actuator 72 may be connected to the air piston 42 by an interference fit, mechanical engagement, separate fasteners, welding, adhesive or the like or combinations of such mechanisms provided a liquid tight seal is made between passage 74 and the air piston 42. Passage 74 is in fluid communication with the cavity 76 of the air piston 42 and extends through the actuator 72 to the exterior of the housing 2. In one embodiment, where the bottom portion 6 of housing 2 is permanently attached to the container 10, the connection between the components in the bottom portion 6 and the components in the top portion 4 may be made at the interface between the actuator 72 and the air piston 42 where the nipple engages the actuator 72 in a snap-fit, interference fit or friction fit coupling. In such an arrangement the nipple 70 may be inserted into the actuator 72 and the connection made by moving the top portion 4 and bottom portion 6 toward one another.

The actuator 72 extends to the exterior of the housing 10 via an aperture 78 such that the actuator 72 may reciprocate relative to the housing 10 along the axis of the housing. Fins 88 may be provided on actuator 72 that slidably engage aperture 78 to guide the movement of the actuator 72 in a reciprocating path in housing 10. Passageways 89 are formed by the recessed areas between the fins 88 and the wall of aperture 78 that allow air to flow from the exterior of the pump dispenser into the housing. A suitable fitting 80 connects the exposed end of the actuator 76 to a delivery tube 82. In one embodiment, the connection between the components in may be made at the interface between the actuator 72 and the coupling 80 where the actuator may engage the coupling 80 in a snap-fit, interference fit, friction fit or threaded coupling. In such an arrangement the nipple 70 may be inserted into the actuator 72 and the connection made by moving the top portion 4 and bottom portion 6 toward one another. The distal end 82*a* of the delivery tube 82 delivers the dispensed foamed liquid to a desired point of use. The end of tube 80 may comprise a tip 90 for more cleanly dispensing the foamed liquid. Typically, the delivery tube 82 may be contained in a decorative fixture such as a spigot 97 that is mounted on or over the actuator 72. The pump dispenser may be located adjacent to a sink, shower or other fixture in a bathroom, kitchen or other area where the dispensed foam will be used. However, in some embodiments the delivery tube 82 may be uncovered or it may be covered by any suitable structure.

Liquid check valve 98 is located in the liquid chamber 20 that controls flow of liquid from the liquid chamber 20 to the mixing chamber 56. In one embodiment the check valve 98 comprises a valve seat 100 formed in the piston tube 58 in the liquid path. The valve seat 100 may be closed by a valve element 102, such as a ball, duckbill valve element or the like. The valve element 102 is biased to the closed position against valve seat 100 by a compression spring 104 that is mounted on a spring perch 107 formed on compression ring 106. While specific embodiments of one-way check valves have been described any suitable valve may be used.

The compression ring 106 is connected to the end of the piston tube 58. One or both of the compression ring 106 and the end of the piston tube 58 may be formed with apertures 108 such that a liquid flow path is created between the liquid chamber 20 and the mixing chamber 56. Fluid may flow from the liquid chamber 20 into the mixing chamber 56 through the apertures 108 as will be described. The compression ring 106 is made of a resilient material such as an elastomer such that it may be compressed between the liquid piston 40 and the air piston 42. The compression ring 106 further comprises a central bore 110 that communicates the apertures 108 with the foam densifier 68. As a result, liquid may flow from the container 10 through the fluid chamber 20 and into the mixing chamber 56. Foamed liquid may flow from the mixing chamber 56 through the compression ring 106 and into the foam densifier 68. The foam densifier 68 is in fluid flow communication with the passage 74 such that foamed liquid may be delivered via these elements to delivery tube 82.

The foam densifier 68 is mounted to the compression ring 106 such that fluid may flow from the mixing chamber 56 through the compression ring 106 and into the densifier 68. The foam densifier 68 comprises a tubular member 112 defining an inlet 114 and an outlet 116. Foamed fluid may flow through the densifier 68 between the inlet and outlet. The inlet 114 is connected to the compression ring 106 and the outlet 116 communicates with cavity 76 and passage 74. Located in the fluid flow path in foam densifier 68 is at least one fine mesh screen 118 that creates a smooth foam with small bubbles. In one embodiment, a plurality of screens, such as a first screen 118 and a second screen 120, may be used where the screens have progressively smaller mesh sizes.

The densifier 68 also supports a flex valve 122 that selectively closes apertures 124 formed in the air piston 42 that communicate the mixing chamber 56 with the atmosphere side air chamber 65. The flex valve 122 is arranged such that high pressure on the bottom of the valve, in the mixing chamber 56, seals the flex valve against the air piston 42 to close the apertures 124 and high pressure on the atmosphere side air chamber 65 deforms the flex valve to open the apertures 124 and allow air to flow between the atmosphere side air chamber 65 and the mixing chamber 56.

Figure 15:
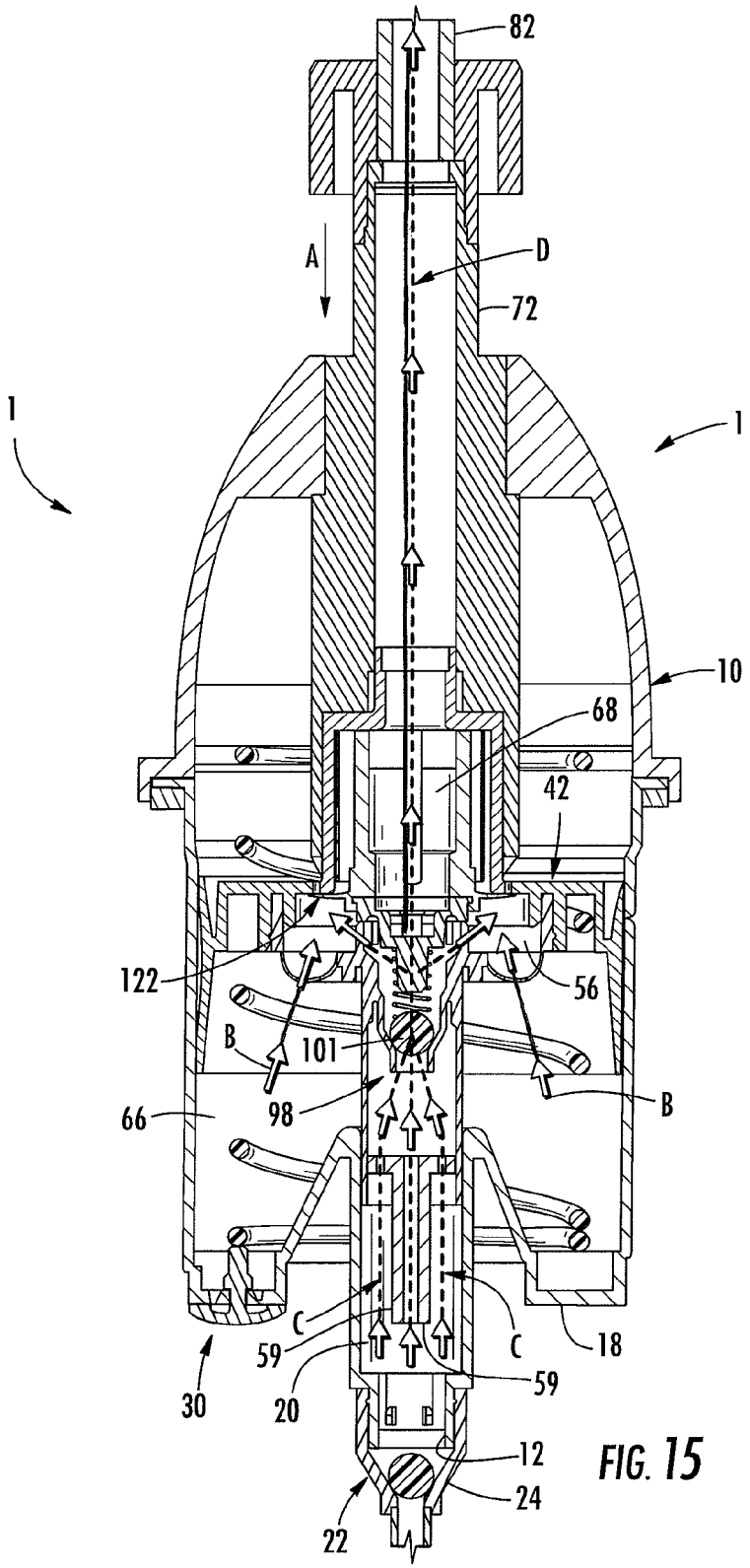
FIGS. 15 and 16 are section views useful in explaining the operation of the pump dispenser of the invention.

Operation of the pump dispenser 1 will now be described with particular reference to FIGS. 15 and 16. FIG. 15 shows the pump dispenser 1 at the rest position where the fluid chamber 20 is filled with liquid from the previous cycle. To dispense foam from the tube 82, the actuator 72 is moved from the position of FIG. 15 to the position of FIG. 16 in a compression stroke where downward movement of the actuator 72 pumps foam from the dispenser. To actuate the pump dispenser, the actuator 72 is depressed in the direction of arrow A to force the actuator 72 and the piston assembly toward the bottom 18 of housing 10. The actuator 72 may be depressed by a manual operation where a user depresses the actuator manually. A user may depress or otherwise manipulate a user control that is operatively coupled to the actuator. In some embodiments the user may depress the fixture 97 that receives the delivery tube 82 and that is mounted on the actuator 72. In such an embodiment, the fixture 97, delivery tube 82 and actuator 72 are all moved manually downward. In other embodiments the user may depress a separate lever or other operator that is operatively coupled to the actuator 72. In some embodiments, the actuator 72 may be moved by a driven operator such as an electric motor coupled to a rotary cam or other transmission where the motor is energized by activation of a sensor by the user. The motor may be energized in response to a touchless sensor such as an infrared sensor, a touch sensor, a mechanical switch or the like.

Figure 16:
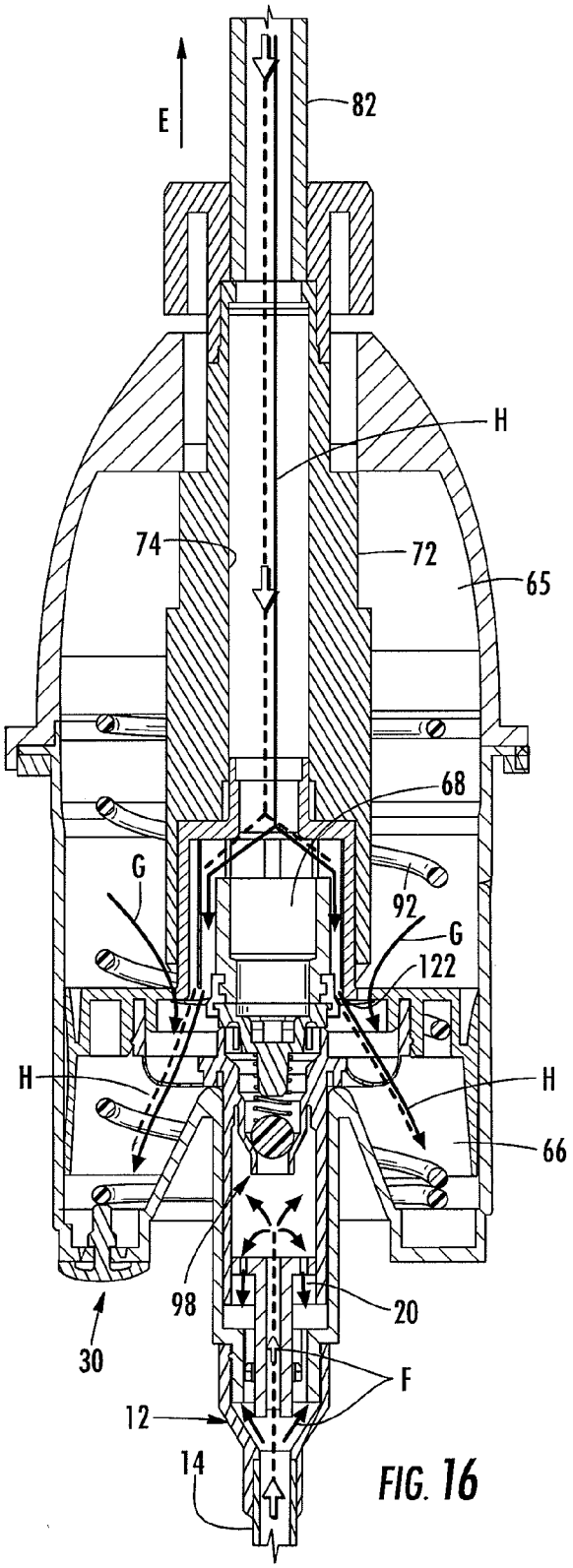

As the actuator 72 moves downward from the position of FIG. 15 to the position of FIG. 16, the inlet check valve 22 is closed as the pressure in the system created by the movement of the actuator 72 forces the valve element 24 against the valve seat 26. The liquid check valve 98 is simultaneously opened as the pressure in the liquid chamber 20 forces the valve element 101 away from the valve seat 103. The increase in pressure in the air chamber 66 also slightly opens the drain valve 30 to allow any residual foamed liquid in the air chamber 66 to drain back into the container 10. The residual foamed liquid is drawn into the air chamber 66 on the extension stroke of the actuator 72 as will hereinafter be described. The flexible air seal 122 is also closed as the air/liquid and foam pressure in the mixing chamber 56 forces the air seal 122 against the air piston 42 where the seal 122 covers and closes apertures 124.

Air flows from the air chamber 66 into the mixing chamber 56 via the apertures 62 formed in diaphragm 60 as represented by solid line arrows B. Liquid also flows from the liquid chamber 20 through the check valve 98 and into the mixing chamber 56 as represented by dashed line arrows C. The liquid and air mix under pressure in the mixing chamber 56 to form a coarse liquid foam. The coarse foam flows through the compression ring 106 and into the foam densifier 68 where the progressively finer meshes in the foam densifier create a more consistent and smooth foam with a small bubble size. The densified foam, as represented by solid and dashed line arrows D, travels from cavity 76 through the passage 74 in the actuator 72 and into and through the delivery tube 82 to be dispensed from the end 82*a* of the delivery tube into, for example, a user's hands.

FIGS. 2 and 16 show the pump dispenser at the end of the compression stroke. In this position, movement of the liquid piston 40 is stopped as the stop 122 formed on the liquid piston 40 contact stop 125 formed on the housing 10. Tube 59 engages the valve element 24 to hold the valve closed. The air piston 42, however, continues its downward movement relative to the liquid piston 40 due to the flexing of the curved flexible diaphragm 60 and the compression of compression ring 106. The short relative movement between the liquid piston 40 and the air piston 42 produces a short burst of air flow into the mixing chamber 56 without any additional liquid flowing into the mixing chamber. The burst of air mixes with any residual liquid in the mixing chamber 56 that was not previously converted to foam to foam the residual liquid. At this point the compression stroke is complete and a dose of foamed liquid is completely delivered to the user via delivery tube 82.

The extension stroke begins from the position of FIG. 16 when the force on the actuator 72 is released and the system moves from the position of FIG. 16 to the position of FIG. 15. The force on actuator 72 may be released by a user physically releasing the actuator or the force may be released when the motorized actuator releases the actuator 72. When the force is released, the pump spring 92 moves the actuator 72 and piston assembly upward in the direction of arrow E. In some embodiments such as a motorized actuator the spring may be eliminated and the motorized actuator may drive the piston assembly in both directions.

As the actuator and piston assembly move in the direction of arrow E, the inlet check valve 22 is opened as vacuum pressure is created above the check valve 22 by the movement of the liquid piston 58 out of liquid cylinder 16. Fluid flows from the container 10 via the fill tube 14 and into chamber 20 under the force of the vacuum pressure to refill the chamber 20 as represented by dashed line arrows F.

The liquid piston check valve 98 is closed as the vacuum pressure generated below the valve element moves the valve element toward and into engagement with the valve seat. Because the valve 98 is closed the liquid from container 10 is trapped in chamber 20 until the next activation cycle of the pump dispenser. The drain valve 30 is closed due to the vacuum pressure formed in the air cylinder 66. The flexible seal 122 is also opened due to the vacuum pressure in the air cylinder 66. Air flows from the atmosphere into the mixing chamber 66 via apertures 124 and through the mixing chamber into the air cylinder 66 via apertures 62 as represented by solid arrows G. The amount of air flow is controlled to withdraw a desired amount of residual foam from the delivery tube 82. The vacuum created by the upward movement of the piston assembly draws residual foam from the tube 82 back through the passage 74 and into the air chamber 66 as represented by dashed/solid arrow H. The foam follows the path of least resistance around the foam densifier 68, past the check valve 122, through mixing chamber 56 and into the air cylinder 66. The residual foam that was withdrawn from the delivery tube 82 and any residual liquid in the mixing chamber drains to the air chamber 66. The residual foam drains from the air chamber 66 to the container 10 via drain valve 30 during the next compression stroke.

Figure 17:
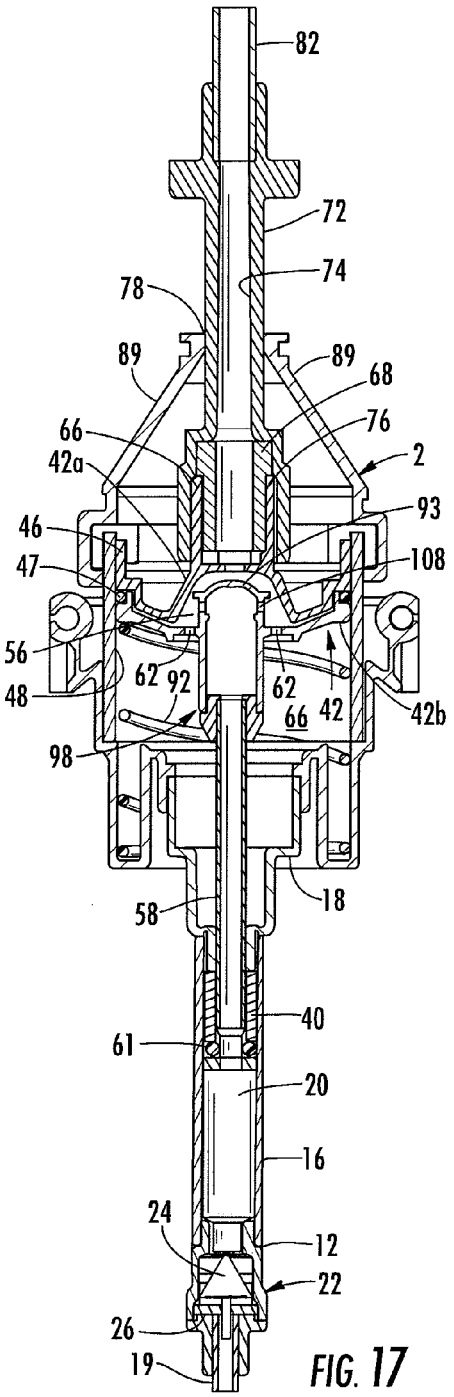
FIG. 17 is a section view of another embodiment of the pump dispenser of the invention.

Another embodiment of the pump dispenser of the invention is shown in FIG. 17. The pump dispenser may comprise a housing 2 that supports the pump components. The bottom 18 of the housing 2 is connected to a liquid inlet 12 for receiving the liquid from the container 10 via a fill tube 14. The inlet 12 is in fluid communication with a liquid cylinder 16 that is secured to the bottom wall 18 of the housing 2 and defines a part of the liquid chamber 20 through which liquid flows from the container 10 into the pump dispenser 1. Intermediate the inlet 12 and the fill tube 14 is a liquid cylinder check valve 22 comprising a movable valve element 24 that selectively seals against valve seat 26 to close the inlet 12 as will be described. The check valve may have a variety of configurations, for example, the valve may comprise a low crack pressure valve such as a duck bill valve. Other suitable check valves may also be used.

The pump dispenser further comprises a liquid piston 40 that is coupled to an air piston 42 such that the air piston 42 and the liquid piston 40 are concentrically mounted. The air piston 42 and the liquid piston 40 form a piston assembly that moves in a linear reciprocating manner inside of the housing 2. A spring 92 may be located in the housing 10 that has one end disposed in a seat formed on the housing 10 and the opposite end biasing the piston assembly upward.

The air piston 42 is defined by an outer wall 46 that engages the generally cylindrical inner cylinder wall 48 of the housing 10 to form an air tight seal therebetween. A seal 47 may be provided that engages the inner wall 48 of the housing 10 to form a seal between the air piston 42 and the housing. The air piston 42 and seal 47 are arranged such that the air piston 42 is free to move along the longitudinal axis of the housing toward and away from inlet 12 while maintaining the seal with the housing wall. The air piston comprises an upper portion 42*a* and a lower portion 42*b* that define the mixing chamber therebetween. The air piston 42 is mounted to the liquid piston 40 such that these pistons move together as a piston assembly in housing 10.

The piston tube 58 is slidably received in the cylinder 16. The piston tube 58 and cylinder 16 together create the liquid chamber 20. The end of the piston tube 58 forms a liquid tight seal 61 with the interior of the cylinder 16 such that liquid in chamber 20 may only exit the chamber 20 via valve check valve 98. An O-ring may be used to create the seal 61.

The air piston 42 further comprises a portion 66 that extends from the top thereof to create a cavity 76 for receiving a foam densifier 68. Located in the fluid flow path in foam densifier 68 comprising one or more of screens, such as a first screen 118 and a second screen 120, where the screens have progressively smaller mesh sizes as previously described.

The exterior of portion 66 connected to a passage 74 formed in actuator 72 such that a liquid tight seal is formed between the mixing chamber 56 and the passage 74 of actuator 72. Passage 74 extends through the actuator 72 to the exterior of the housing.

The actuator 72 extends to the exterior of the housing 10 via an aperture 78 such that the actuator 72 may reciprocate relative to the housing 10 along the axis of the housing. Stabilizers 89 may be provided to guide and stabilize the movement of the actuator 72 in a reciprocating path in housing 10.

Liquid check valve 98 is located in the liquid chamber 20 that controls flow of liquid from the liquid chamber 20 to the mixing chamber 56. A bubbler 93 comprising apertures 108 is disposed between the liquid chamber 20 and the mixing chamber. Fluid may flow from the liquid chamber 20 into the mixing chamber 56 through the apertures 108 of bubbler 93 as will be described. As a result, liquid may flow from the container 10 through check valve 98 and into the mixing chamber 56. Foamed liquid may flow from the mixing chamber 56 and into the foam densifier 68 via aperture 120. The foam densifier 68 is in fluid flow communication with the passage 74 such that foamed liquid may be delivered via these elements to delivery tube 82.

The operation of the pump assembly will be described. On the compression stroke when the actuator is moved downward liquid flows out of the liquid chamber 20 and into the mixing chamber 56 via valve 98. Simultaneously air flows out of the air chamber 66 and into the mixing chamber 56 via apertures 62 while the primary bubbler 93 introduces air and foam to the liquid. The coarse foamed liquid is then forced through the foam densifier 68 and into passage 74 and delivery tube 82 from which it is dispensed for use.

On the extension stroke when the actuator 72 is moved upward the check valve 24 is opened due to the vacuum created in the pump and the liquid chamber 20 is filled with liquid. The air chamber 66 is filled with the residual foam from the delivery tube 82 as the foam is drawn back into the air chamber via foam densifier 68, aperture 20 and aperture 62. The foam may bypass the densifier using the arrangement previously described with reference to FIG. 1 Foam may also be drawn into bubbler 93 via aperture 108. After the delivery tube is cleared of residual foam air from the atmosphere is drawn into the air chamber to fill the chamber. In order to prevent drawing fluid from the liquid chamber 20, the crack pressure of the high crack pressure valve 98 must exceed the vacuum pressure generated to draw back the foam and air through the delivery tube during the extension cycle.

Figure 18:
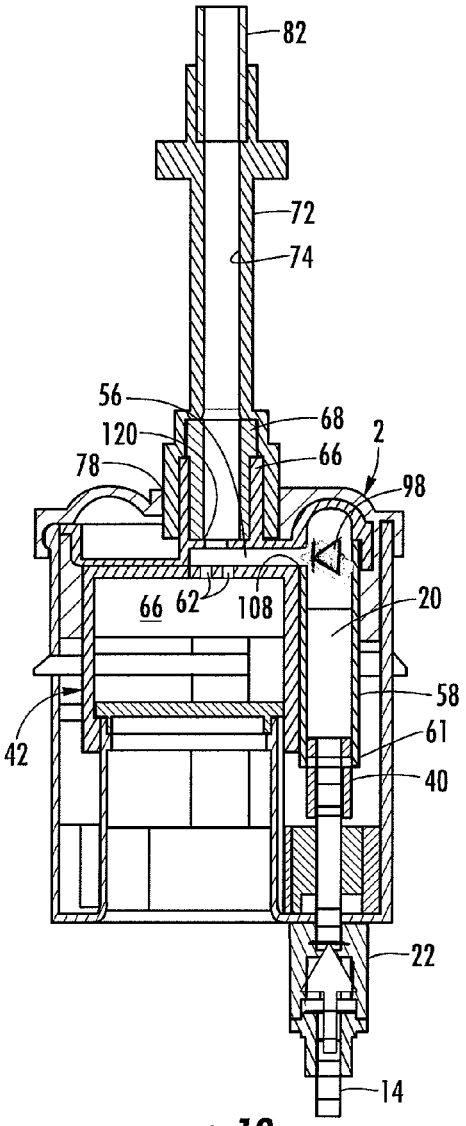
FIG. 18 is a section view of yet another embodiment of the pump dispenser of the invention.

Another embodiment of the pump dispenser of the invention is shown in FIG. 18 that is similar to the embodiment of FIG. 17 except that the air chamber 66 and the liquid chamber 20 are arranged in a side-by-side manner rather than being arranged in line with one another. The mixing chamber 56 is disposed between the air piston 42 and the liquid cylinder 58. The operation of the pump assembly will be described. On the compression stroke when the actuator 72 is moved downward, liquid flows out of the liquid chamber 20 and into the mixing chamber 56 through check valve 98. Simultaneously, air flows out of the air chamber 66 and into the mixing chamber 56 via apertures 62 of the bubbler introducing air and foam to the liquid. The coarse foamed liquid is then forced from mixing chamber 56 through the foam densifier 68 and into passage 74 and delivery tube 82 from which it is dispensed for use.

On the extension stroke, when the actuator 72 is moved upward the check valve 22 is opened due to the vacuum created in the pump and the liquid chamber 20 is filled with liquid. The air chamber 66 is filled with the residual foam from the delivery tube 82 as the foam is drawn back into the air chamber 66. After the delivery tube 82 is cleared of residual foam, air from the atmosphere is drawn into the air chamber 66 to fill the chamber. In order to prevent drawing fluid from the liquid chamber 20, the crack pressure of the high crack pressure valve 98 must exceed the vacuum pressure generated to draw back the foam and air through the delivery tube 82 during the extension cycle.

Some plastic components may be injection molded. Flexible components may be injection or pressure molded. The steel parts may be made of stainless steel. The pump is a compact device with a minimum number of components that simplifies assembly and has a low failure rate.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A dispenser comprising:

a liquid piston and an air piston coupled for movement;

an actuator for moving the liquid piston and the air piston in a first direction such that the air piston delivers air from an air chamber to a mixing chamber through a first aperture and the liquid piston delivers a liquid from a liquid chamber to the mixing chamber where the air and liquid are mixed in the mixing chamber to create a foam;

a second aperture connecting the mixing chamber to the external atmosphere and a passage connecting the mixing chamber to a delivery tube for dispensing the foam, a valve for closing the second aperture and the passage when the liquid piston and air piston are moved in the first direction;

a third aperture connecting the mixing chamber to the delivery tube;

wherein movement of the liquid piston and the gas piston in a second direction opens the valve and draws residual foam from the delivery tube through the passage and draws air from the external atmosphere into the mixing chamber through the second aperture, the air from the external atmosphere and the residual foam from the delivery tube being delivered to the air chamber through the first aperture.

2. The dispenser of claim 1 wherein the air chamber is in communication with a source of the liquid via a drain valve.

3. The dispenser of claim 2 wherein the drain valve opens when the liquid piston and the gas piston move in the first direction.

4. The dispenser of claim 1 wherein movement of the liquid piston and the gas piston in the second direction draws liquid from a container into the liquid chamber.

5. The dispenser of claim 4 wherein movement of the liquid piston and the gas piston in the second direction opens a valve between the container and the liquid chamber.

6. The dispenser of claim 1 wherein movement of the liquid piston and the gas piston in the first direction opens a drain valve in the air chamber to allow residual foam in the air chamber to drain from the air chamber.

7. The dispenser of claim 1 wherein at least a portion of the liquid piston is mounted for movement relative to the air piston.

8. The dispenser of claim 7 wherein a flexible diaphragm connects the at least a portion of the liquid piston to the air piston.

9. The dispenser of claim 7 wherein a compression member is disposed between the air piston and the liquid piston.

10. The dispenser of claim 7 wherein the relative movement between the air piston and the liquid piston draws air into the mixing chamber without drawing liquid into the mixing chamber.

11. The dispenser of claim 1 further comprising a foam densifier disposed between the mixing chamber and the delivery tube such that the foam passes through the foam densifier to the delivery tube.

12. The dispenser of claim 11 wherein the passage bypasses the foam densifier as the residual foam is delivered to the air chamber.

13. The dispenser of claim 1 wherein movement of the liquid piston and the gas piston in the second direction creates a vacuum in the liquid chamber that draws liquid from the container.

14. The dispenser of claim 1 wherein movement of the liquid piston and the gas piston in the second direction creates a vacuum in the air chamber that draws residual foam from the delivery tube.

15. A dispenser comprising:

a housing;

a liquid piston and an air piston coupled for movement in the housing where the liquid piston and the gas piston are mounted for movement relative to one another to define a mixing chamber therebetween;

an actuator for simultaneously moving the liquid piston and the air piston in a first direction such that the air piston delivers air from an air chamber to a mixing chamber and the liquid piston delivers a liquid from a liquid chamber to the mixing chamber where the air and liquid are mixed in the mixing chamber to create a foam;

delivery tube for dispensing the foam;

a foam densifier disposed between the mixing chamber and the delivery tube;

wherein movement of the liquid piston and the gas piston in a second direction draws residual foam from the delivery tube and delivers the residual foam from the delivery tube to the air chamber;

wherein movement of the liquid piston and the gas piston in the first direction opens a drain valve in the air chamber to allow the residual foam in the air chamber to drain from the air chamber.

16. A method of dispensing a foam comprising:

providing a liquid piston and a gas piston defining a mixing chamber and a delivery tube for dispensing a foam from the mixing chamber;

moving the liquid piston and the air piston in a first direction such that the air piston delivers air from an air chamber to the mixing chamber and the liquid piston delivers a liquid from a liquid chamber to the mixing chamber such that the air and liquid are mixed in the mixing chamber to form the foam;

moving the liquid piston and the gas piston in a second direction to draw residual foam from the delivery tube and air from the external atmosphere and to deliver the residual foam from the delivery tube and air from the external atmosphere to the air chamber;

controlling the amount of air drawn from the delivery tube to withdraw a desired amount of foam from the delivery tube.

* * * * *